United States Patent [19]

Opresko

[11] Patent Number: 4,514,660

[45] Date of Patent: Apr. 30, 1985

[54] CATHODE-RAY TUBE HAVING AN ELECTRON GUN ASSEMBLY WITH A BIMETAL CATHODE EYELET STRUCTURE

[75] Inventor: Stephen T. Opresko, Manor Township, Lancaster County, Pa.

[73] Assignee: RCA Corporation, Princeton, N.J.

[21] Appl. No.: 556,185

[22] Filed: Nov. 29, 1983

[51] Int. Cl.[3] ..... H01J 29/06; H01J 29/46; H01J 9/02

[52] U.S. Cl. ..... 313/446; 313/456; 445/36

[58] Field of Search ..... 313/446, 456, 38, 270, 313/337; 445/34, 36

[56] References Cited

U.S. PATENT DOCUMENTS

| | | | |
|---|---|---|---|
| 2,914,694 | 11/1959 | Chin | 313/270 |
| 3,145,318 | 8/1964 | Paull | 313/82 |
| 3,265,920 | 8/1966 | Fiore | 313/240 |
| 3,351,792 | 11/1967 | Kuryla | 313/38 |
| 3,822,392 | 7/1970 | Turnbull et al. | 445/36 |
| 4,063,128 | 12/1977 | Hughes | 313/409 |
| 4,210,988 | 7/1979 | Bowes et al. | 313/271 |
| 4,370,588 | 1/1983 | Takahashi et al. | 313/270 |

OTHER PUBLICATIONS

U.S. patent application, Ser. No. 556,184, filed concurrently herewith, by R. E. Schlack, entitled, "Cathode-Ray Tube Having an Electron Gun with Emissivity Modifying Means".

*Primary Examiner*—Palmer Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

A cathode-ray tube having an electron gun includes at least one cathode assembly comprising a tubular cathode sleeve, a heater filament disposed within the sleeve and a novel cathode eyelet coaxially surrounding at least a portion of the cathode sleeve and attached thereto. The cathode sleeve has oppositely disposed ends, one end being open and the other end being closed by a cap having an electron emitting coating thereon. The novel eyelet comprises a laminated bimetal member including a support layer and an emissivity modifying layer. The support layer has a distal end, a proximal end and a central portion therebetween. The proximal end of the support layer is attached to the open end of the cathode sleeve. The emissivity modifying layer is disposed on at least a portion of the interior surface of the central portion of the support layer to reduce radiation loss from the cathode sleeve and cap. The emissivity modifying layer is spaced from the proximal end of the support layer by a heat dam which reduces conduction loss up the eyelet. A method of altering the thermal characteristics of the cathode assembly is also disclosed.

7 Claims, 2 Drawing Figures

CATHODE-RAY TUBE HAVING AN ELECTRON GUN ASSEMBLY WITH A BIMETAL CATHODE EYELET STRUCTURE

BACKGROUND OF THE INVENTION

The invention relates to a cathode-ray tube having an electron gun assembly therein and more particularly to an improved cathode eyelet for the electron gun assembly. The improved cathode eyelet reduces thermal losses thereby reducing the power requirements of the tube.

U.S. Pat. No. 2,914,694, issued to T. N. Chin on Nov. 24, 1959, describes a low power cathode for an electron discharge device. A cathode sleeve is supported by a funnel-shaped member made of a material, such as a cobalt-nickel-iron alloy, having low heat conduction properties to minimize heat loss to the other cathode support structures. A cathode shield, also made of the same low heat conduction property material, surrounds and supports the funnel-shaped member. The funnel-shaped member and the cathode shield are provided with bright inner surfaces to reflect as much heat as possible back toward a cathode cap.

U.S. Pat. No. 4,370,588, issued to Takahashi et al. on Jan. 25, 1983, discloses a low power cathode having a cathode sleeve which is blackened to uniformly radiate heat. A first cylindrical reflective member surrounds the upper portion of the cathode sleeve and reflects heat from the cathode sleeve to reduce heat radiation to the outside. A second cylindrical reflective member supports the cathode sleeve. The inner surface of the second reflective member also reflects heat from the cathode sleeve so that it is not radiated to the outside to provide a power savings.

The aforementioned cathode structures each comprise a number of parts which require careful and costly assembly steps. Therefore, there is a need for a simple cathode structure that provides both low conductive and low radiative losses.

SUMMARY OF THE INVENTION

A cathode-ray tube having an electron gun includes at least one cathode assembly comprising a cathode sleeve, a heater filament disposed within the sleeve and a novel cathode eyelet surrounding at least a portion of the cathode sleeve and attached thereto. The cathode sleeve has oppositely disposed ends, one end being open and the other end being closed by a cap having an electron emitting coating thereon. The novel eyelet comprises a laminated bimetal member including a support layer and an emissivity modifying layer. The support layer has a distal end, a proximal end and a central portion therebetween. The proximal end of the support layer of the eyelet is attached to the open end of the cathode sleeve. The emissivity modifying layer is disposed on at least a portion of the interior surface of the central portion of the support layer. The emissivity modifying layer is spaced from the proximal end of the support layer.

DETAILED DESCRIPTION OF THE PREFERRED EMBODIMENT

Figure 1:
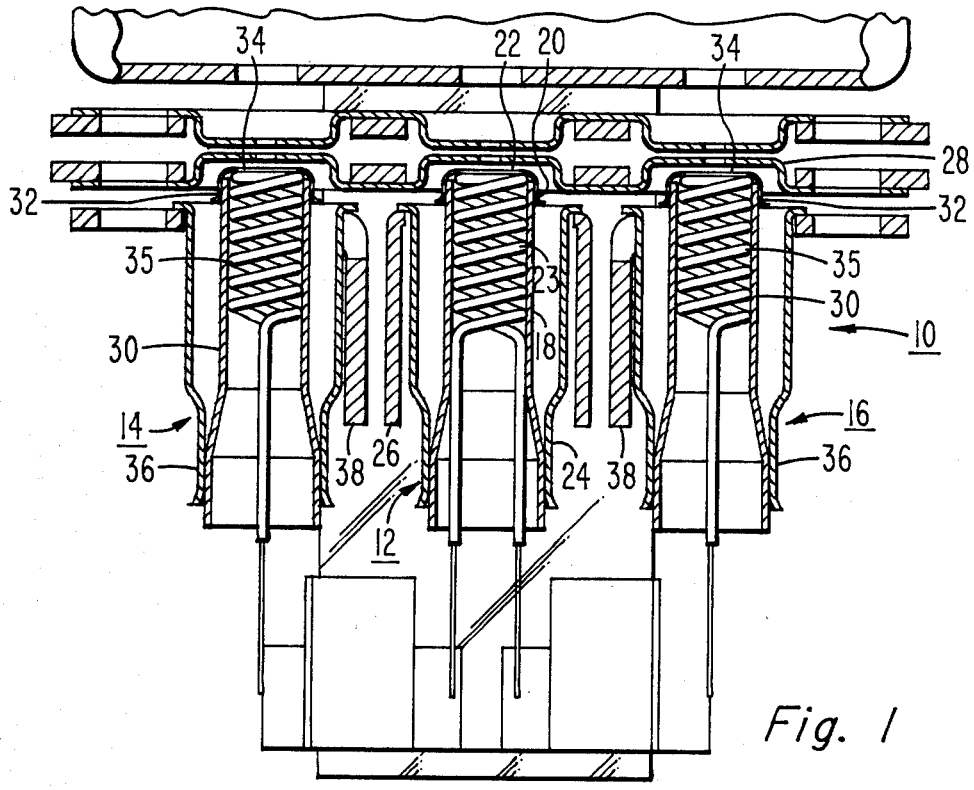
FIG. 1 is a sectional view of a portion of an inline electron gun assembly.

In FIG. 1, there is shown a portion of an electron gun assembly 10 of a type used in color television picture tubes. Except for a different cathode eyelet construction, a prior art electron gun assembly and a low power electron gun assembly made in accordance with the present invention utilize substantially the same structure; consequently, the detailed description of the structure of FIG. 1 is applicable to both.

The electron gun assembly 10 comprises a center cathode assembly 12, a first outer cathode assembly 14, and a second outer cathode assembly 16. The center cathode assembly 12 comprises a tubular cathode sleeve 18 closed at the forward end by a cap 20 having an end coating 22 of an electron emitting material thereon. A heater filament 23 is mounted within the cathode sleeve 18. The electron emitting coating 22 is supported at a predetermined spacing from the aperture plane of a G1 grid 28 (also referred to as the control grid) by a center cathode eyelet 24 which is coaxially disposed around at least a portion of the cathode sleeve 18 and attached to the cathode sleeve 18 as well as to a fixed center cathode beading support member 26.

Similarly, the first and second outer cathode assemblies 14 and 16, which are identical to the center cathode assembly 12, each comprise a tubular cathode sleeve 30 closed at the forward end by a cap 32 having an end coating 34 of an electron emitting material thereon. A heater filament 35 is mounted within each cathode sleeve 30. The electron emitting coatings 34 are each maintained at a predetermined spacing from the G1 grid 28 by a cathode eyelet 36 which is coaxially disposed around at least a portion of the cathode sleeve 30 and attached to the cathode sleeve 30 as well as to a fixed outer cathode beading support member 38. The predetermined spacings of the outer cathode assemblies are also established during fabrication and are substantially equal to the spacing of the center cathode assembly, which is approximately 0.13 mm.

Figure 2:
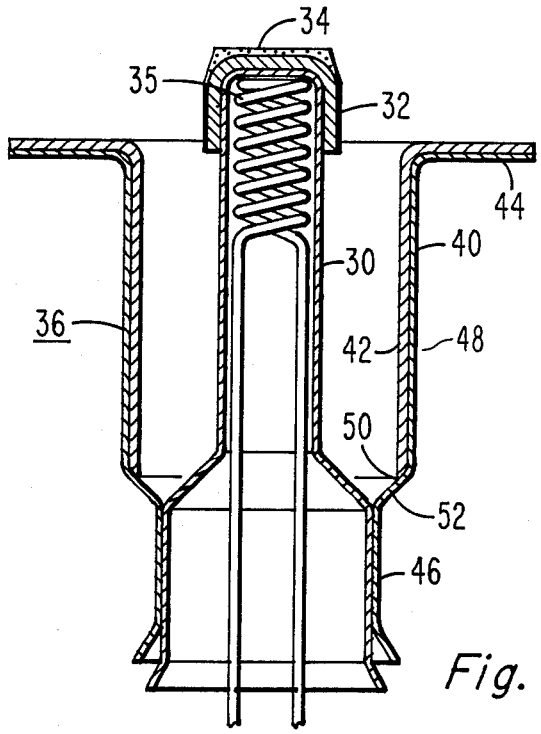
FIG. 2 is an enlarged sectional view of the novel eyelet of the present invention.

FIG. 2 shows an enlarged sectional view of one of the novel outer cathode eyelets 36. The novel center eyelet 24 is identical to the outer eyelet 36. The eyelet 36 comprises a laminated bimetal member including an outer support layer 40 and an interior emissivity modifying layer 42. The outer layer 40 is preferably formed of Nichrome (an alloy of nickel and chromium), which has a thermal conductivity of about 0.195 watts/cm./°K. at 700° K. Typically, the outer support layer 40 has a thickness of the order of about 0.025 mm (1 mil). The total hemispherical emissivity of the Nichrome outer layer 40 ranges from about 0.54 at about 700° K. to about 0.735 at 1273° K. The interior emissivity modifying layer 42 is preferably formed of bright nickel, which has a thermal conductivity of about 0.65 watts/cm./°K. at 700° K. and a thickness ranging from about 0.01 mm (0.5 mils) to about 0.05 mm (2 mils). The total hemispherical emissivity of the nickel interior layer 42 ranges from about 0.1 at 700° K. to about 0.23 at 1273° K. Emissivity is defined as the ability of a surface to emit radiant energy compared to that of a black body at the same temperature and with the same area. Generally, a material with low emissivity has high reflectivity, because it will absorb heat poorly and, therefore, reflect it. Reflectivity, however, is wavelength and angle dependent, whereas total hemispherical emissivity is not.

The support layer 40 of the eyelet 36 has a distal end 44, a proximal end 46 and a central portion 48. When the eyelet 36 is formed from the bimetal member, the interior nickel layer 42 is contiguous with the support layer 40; however, to minimize thermal losses in the cathode assemblies as described hereinafter, a portion of the nickel interior layer 42 is selectively removed, for example, by etching, in a suitable mixture of acetic and nitric acids. The etching exposes a portion of the support layer 40 thereby forming a heat dam 52 and an attachment portion at the proximal end 46. The remaining nickel interior layer 42 extends along the distal end 44 and along at least a portion of the interior surface of the central portion 48 to a lower extremity 50. The heat dam 52 is formed along the region of the central portion 48 of the support layer 40 that extends from the lower extremity 50 of the nickel interior emissivity modifying layer 42 to the proximal end 46 of the support layer 40. The open end of the cathode sleeve 30 is attached, for example, by welding to the proximal end 46 of the support layer 40. The unitized structure of the eyelet, which provides both support layer 40 and emissivity modifying layer 42, is vastly superior to prior art structures, which utilized a large number of support and reflective members to support the cathode sleeve.

During tube operation, the heater filament 35 raises the temperature of the upper portion of the cathode sleeve 30 and cap 32 to a temperature of about 1050° K., causing electrons to be emitted from the end coating 34. The low emissivity nickel interior layer 42 reflects heat radiated by the cathode sleeve 30 back to the sleeve and the cap 32, thereby minimizing radiation loss from the cathode assembly. Since the open end of the sleeve 30 is attached directly to the proximal end 44 of the Nichrome support layer 40, which has a lower thermal conductivity than the nickel interior layer 42, the thermal loss by heat conductivity across the heat dam 52 and up the eyelet 36 is reduced. While the interior surface of the heat dam 52, which comprises Nichrome, has a higher emissivity than does the interior nickel layer 42, radiative loss through the heat dam 52 is small because the heat dam is sufficiently far away from the upper portion of the cathode sleeve 30 and the end cap 32 that the higher emissivity of the heat dam has little effect on heat loss by radiation. The thermal characteristics of the cathode assembly can be altered by varying the thermal conductivity properties of the eyelet, for example, by changing the height of the lower extremity 50 of the nickel interior layer 42. This changes the length of the heat dam 52 to effect heat conduction across the dam 50 and radiation through the dam. Also, the thermal conductivity of the eyelet 36 can be varied by changing the thickness of the bimetal members.

What is claimed is:

1. In a cathode-ray tube having an electron gun including at least one cathode assembly comprising a cathode sleeve having oppositely disposed ends, said cathode sleeve being open at one end and closed at the other end by a cap having an electron emitting coating thereon, a heater filament disposed within said sleeve and spaced therefrom, and a cathode eyelet disposed around at least a portion of said cathode sleeve and attached thereto, the improvement wherein said cathode eyelet comprises a laminated bimetal member including a support layer and an emissivity modifying layer, said support layer having a distal end, a proximal end and a central portion therebetween, said proximal end being attached to said open end of said cathode sleeve, said emissivity modifying layer being disposed on at least a portion of the interior surface of said central portion of said support layer, said emissivity modifying layer being spaced from said proximal end of said support layer.

2. The tube as in claim 1 wherein said central portion of said support layer of said bimetal member further includes a heat dam disposed adjacent to said proximal end of said support layer.

3. In a cathode-ray tube having an electron gun including a plurality of cathode assemblies, each of said cathode assemblies comprising a tubular cathode sleeve having oppositely disposed ends, said cathode sleeve being open at one end and closed at the other end by a cap having an electron emitting coating thereon, a heater filament disposed within said sleeve and spaced therefrom, and a cathode eyelet coaxially disposed around at least a portion of said cathode sleeve and attached thereto, the improvement wherein said cathode eyelet comprises a laminated bimetal member including a support layer and an emissivity modifying layer, said support layer having a thermal conductivity lower than that of said emissivity modifying layer, said support layer having a distal end, a proximal end and a central portion including a heat dam between said distal end and said proximal end, said proximal end being attached to said open end of said cathode sleeve, said emissivity modifying layer having lower emissivity than said support layer and being disposed on at least a portion of the interior surface of said central portion of said support layer, said emissivity modifying layer being spaced from said proximal end of said support layer by said heat dam.

4. The tube as in claim 3 wherein said support layer of said bimetal member comprises an alloy of nickel and chromium and said emissivity modifying layer comprises nickel.

5. The tube as in claim 3 wherein said electron gun is an inline gun.

6. The tube as in claim 3 wherein said electron gun is a delta gun.

7. A method for altering the thermal characteristic of a cathode assembly including a cathode sleeve having an open end and a closed end with an electron emitting coating on said closed end, a heater filament disposed within said sleeve, a laminated bimetal cathode eyelet disposed around at least a portion of the cathode sleeve, wherein said bimetal cathode eyelet comprises a support layer and an emissivity modifying layer, said support layer having a thermal conductivity lower than that of said emissivity modifying layer, said method comprising the steps of selectively removing a portion of the emissivity modifying layer from one end of said laminated bimetal eyelet thereby exposing said support layer to form a heat dam and an attachment portion of said support layer, and attaching said open end of said cathode sleeve to said attachment portion of said support layer whereby said heat dam retards the conduction of heat from said cathode assembly.

* * * * *